US010981764B2

(12) United States Patent
Pautz et al.

(10) Patent No.: US 10,981,764 B2
(45) Date of Patent: Apr. 20, 2021

(54) INDUSTRIAL TRUCK HAVING A FORK AND A FORK ARM CAMERA AND METHOD FOR OPERATING SUCH AN INDUSTRIAL TRUCK

(71) Applicant: Jungheinrich AG, Hamburg (DE)

(72) Inventors: Alexander Pautz, Hamburg (DE); Lars Dohrmann, Hamburg (DE); Sebastian Rockel, Hamburg (DE)

(73) Assignee: Jungheinrich AG, Hamburg (DE)

( * ) Notice: Subject to any disclaimer, the term of this patent is extended or adjusted under 35 U.S.C. 154(b) by 111 days.

(21) Appl. No.: 16/169,037

(22) Filed: Oct. 24, 2018

(65) Prior Publication Data

US 2019/0119084 A1 Apr. 25, 2019

(30) Foreign Application Priority Data

Oct. 24, 2017 (DE) ..... 10 2017 124 850.1

(51) Int. Cl.
*B66F 9/075* (2006.01)

(52) U.S. Cl.
CPC ..... *B66F 9/0755* (2013.01)

(58) Field of Classification Search
CPC ..... B62B 2202/92
See application file for complete search history.

(56) References Cited

U.S. PATENT DOCUMENTS

| | | | |
|---|---|---|---|
| 8,965,678 | B2 | 2/2015 | Herrmann |
| 2011/0234389 | A1 | 9/2011 | Mellin |
| 2013/0158851 | A1 | 6/2013 | Herrmann |
| 2016/0138247 | A1 | 5/2016 | Conway et al. |

FOREIGN PATENT DOCUMENTS

| | | | | |
|---|---|---|---|---|
| DE | 19822496 | A1 | 11/1999 | |
| DE | 102006012205 | A1 | 9/2007 | |
| DE | 102010004719 | A1 | 7/2011 | |
| EP | 2653429 | A1 | 10/2013 | |
| EP | 2653429 | B1 | 3/2015 | |
| EP | 3021178 | A1 | 5/2016 | |
| EP | 3037135 | A1 | 6/2016 | |
| GB | 2497627 | A | 6/2013 | |
| JP | 2015174705 | * | 10/2015 | ..... B66F 9/075 |
| WO | 2010054785 | A1 | 5/2010 | |

OTHER PUBLICATIONS

Machine translation, JP2015174705, Morita Junichi, Oct. 5, 2015.*

* cited by examiner

*Primary Examiner* — Anne Marie Antonucci
*Assistant Examiner* — Abdalla A Khaled
(74) *Attorney, Agent, or Firm* — Rankin, Hill & Clark LLP

(57) ABSTRACT

An industrial truck (2) and a method for operating an industrial truck (2). The industrial truck (2) includes an assistance system and a fork (4) having at least two fork arms (61, 62). The assistance system includes at least one fork arm camera (8, 8'), a monitor, and a processing unit (10). The fork arm camera (8, 8') is disposed on the fork (4) such that at least part of a tip (71, 72) of at least one of the two fork arms (61, 62) is present in the field of view of the fork arm camera (8, 8'). The processing unit (10) is set up for capturing at least one tip (71, 72) of the at least one fork arm (61, 62) in the image data, for calculating at least one marking (18) indicating the position of the fork (4), and for reproducing on the monitor the image data captured by the fork arm camera (8, 8') and superimposed with the marking (18).

12 Claims, 5 Drawing Sheets

INDUSTRIAL TRUCK HAVING A FORK AND A FORK ARM CAMERA AND METHOD FOR OPERATING SUCH AN INDUSTRIAL TRUCK

PRIORITY CLAIM

The present application claims priority to German Patent Application No. DE 10 2017 124 850.1, filed Oct. 24, 2017.

BACKGROUND OF INVENTION

Field of Invention

The invention relates to a method for operating an industrial truck having a fork comprising at least two fork arms, a fork arm camera, a monitor, and a processing unit for reading and processing the image data captured by the fork arm camera and for creating and transmitting processed image data displayed on the monitor. The invention further relates to an industrial truck having an assistance system and having a fork comprising at least two fork arms, wherein the assistance system comprises at least one camera, a monitor, and a processing unit.

Brief Description of the Related Art

Industrial trucks such as pallet trucks and forklifts are often used for transporting loads disposed on pallets. To this end, the industrial truck comprises a fork typically having two fork arms for sliding in or inserting into corresponding openings provided in a pallet for lifting the load. Picking up a pallet and correctly inserting the fork arms into the provided load support areas of the pallet, however, is a difficult, arduous, and time-consuming procedure, especially under difficult visibility conditions or when the load forks are raised very high. The handling capacity of the industrial truck is reduced as a result. Greater requirements are also placed on the operator of the industrial truck, particularly with respect to experience and skill.

An industrial truck and a control method, whereby the load-handling equipment of the industrial truck is automatically controlled and aligned to the load to be lifted are known from EP 2 653 429 B1, for example. Such a largely automated system, however, is very costly.

Simpler systems comprise a video camera on the fork of an industrial truck. By means of such a system, the driver can be provided with a simultaneous view from the fork toward the pallet while picking up the pallet. Said system is intended to facilitate the driver optimally positioning the forks in the load support areas of the pallet. The system can be supplemented by a line laser also mounted on the fork carrier. Said laser projects the penetration height onto the pallet based on the current position of the fork. There is a risk, however, that such a line laser can be misaligned during operation of the industrial truck without the operator immediately noticing. The next pallet penetration can then result in damage to the goods or the rack.

BRIEF SUMMARY OF THE INVENTION

The object of the present invention is to disclose a method for operating an industrial truck and an industrial truck having an assistance system, wherein the picking up of freight, particularly pallets, is reliable and facilitated, wherein the system is also robust and not prone to error.

The object is solved by a method for operating an industrial truck having a fork comprising at least two fork arms, a fork arm camera, a monitor, and a processing unit for reading and processing the image data captured by the fork arm camera and for creating and transmitting processed image data displayed on the monitor, said method being refined in that the fork arm camera is disposed on the fork such that at least part of a tip of at least one of the two fork arms is present in the field of view of the fork arm camera, and the processing unit performing the following steps: capturing the at least one tip of the at least one fork arms in the captured image data, calculating at least one marking indicating a position of the fork, and reproducing on the monitor the image data captured by the fork arm camera and superimposed with the marking.

The fork arm camera detects the at least one tip of the at least one fork arm in the captured images. The processing unit calculates markings, such as auxiliary lines to be displayed, to be reproduced on the monitor based on the position of the fork arms. Said auxiliary lines help the fork truck driver to better estimate the exact position of the fork arm tip. This greatly facilitates handling of the industrial truck and accelerates picking up the loads. It is advantageously possible that the processing unit continuously determines the position of the fork arms anew and thus can also check whether said fork arms are still in the expected position. If, for example, a fork arm shifts out of position or if the camera is shifted by an impact on the camera housing, then either a warning can be displayed or the marking (e.g., the auxiliary lines) are simply calculated again and displayed as a function of the new position.

The same camera is used both for capturing images and for calculating the position of the fork arm tips. This makes the system less error-prone in comparison with conventional systems. A plurality of components can also be integrated. The processing unit can optionally be integrated in the camera or in the monitor, for example. It is also no longer necessary to use an additional unit, such as a line laser. A digital 2D camera or a 3D camera can be used as the fork arm camera. It is also possible to combine a 2D camera with a device for measuring distance, for example.

According to an advantageous embodiment, the top edge or top edges of the fork arms are provided as the marking. Alternatively or additionally, the outer edges of the fork arms and/or the center between the fork arms are displayed. It is also provided that the shape of the marking, such as in the center between the fork arms, comprises two vertical lines spaced apart by the width of a connecting block of a Euro-pallet. Said two lines can be made to cover the center block of the Euro-pallet when approaching the Euro-pallet, so that the fork arms can be simply and reliably inserted into the Euro-pallet.

According to a further advantageous embodiment, the processing unit further receives data relating to an angle of inclination of the fork and calculates on the basis of said data an auxiliary marking indicating a deviation of the position of the fork from a zero-degree position of the fork, wherein image data captured by the fork arm camera and superimposed with the auxiliary marking is reproduced on the monitor.

The processing unit receives the data relating to the angle of inclination of the forks from the operating controls of the industrial truck, for example. To this end, the processing unit is set up for calling up the required data, for example. It is further provided that said unit requests the questionable data (that is, sends a query) and somewhat later receives the data in response to said query. The data can also be received by push notification without a query. The zero position of the forks is particularly a position wherein the legs of the fork arms are aligned horizontally.

If the fork is present in the zero-degree position, the auxiliary marking and the marking are congruent. In said alignment of the fork, the fork arms are inserted into the pallet horizontally. If the auxiliary marking and the marking deviate from each other, then the fork arm tips are inserted into the pallet in the region of the auxiliary marking. The top sides of the fork arms, however, then make contact with the pallet, so that the fork cannot be inserted fully. This can be undesirable in some cases. The auxiliary marking, just like the marking, can be a line indicating the top edge of the fork arms.

The method is particularly further refined in that the processing unit further receives data relating to a steering movement angle and calculates on the basis of said data a further auxiliary marking indicating a future deviation of the position of the fork from the current position thereof in a plane of transport for assumed travel at the steering movement angle, wherein image data captured by the fork arm camera and superimposed with the further auxiliary marking is reproduced on the monitor.

The processing unit also receives the data relating to the steering movement angle of the forks from the operating controls of the industrial truck, for example. The effects of the currently set steering movement can be estimated in advance for the forklift driver. The corresponding steering movement can be set deliberately or can be avoided from the beginning.

In addition to a horizontal line, the marking can comprise a vertical line, for example, indicating the center between the fork arm tips. The further auxiliary marking can also be a perpendicular line, for example, of a different color than the vertical line of the main marking. The greater the selected steering movement, the greater the deviation between the vertical auxiliary marking and the vertical main marking.

According to a further embodiment, a load to be picked up having at least two visible load support areas is present in the captured image data, wherein the target positions of the tips of the fork arms are calculated when inserting the fork arms into the visible load support areas and the image data captured by the fork arm camera are displayed on the monitor superimposed with the calculated target position of the tips of the fork arms.

Schematically indicated fork arms can be displayed as the target position of the tips of the fork arms, for example. The position thereof is continuously updated as the distance from the forks to the load to be picked up is reduced. The virtual positions of the fork arms and the actual position of the fork arms can thus be successively made or held congruent by the forklift driver, as can be observed in the live image of the fork arm camera, so that an optimal insertion into the pallet can take place. This greatly facilitates operation of the industrial truck for the forklift driver.

According to a further embodiment, live image data is captured by the fork arm camera, the processing unit performs the indicated steps in real time, and a superposition of a live image and the marking calculated in real time are reproduced on the monitor. This can optionally be modified such that the fork arm positions and the resulting positions of the particularly vertical and/or horizontal markings, particularly the main lines and/or auxiliary lines, are calculated and are valid or displayed as long as the fork arms are not displaced.

The fork arm camera is particularly a digital camera. The processing unit is a computer unit such as an embedded PC.

The object is further solved by an industrial truck having an assistance system and having a fork comprising at least two fork arms, wherein the assistance system comprises at least one camera, a monitor, and a processing unit, wherein the industrial truck is refined in that the fork arm camera is disposed on the fork such that at least part of a tip of at least one of the two fork arms is present in the field of view of the fork arm camera, and wherein the processing unit is set up for capturing at least one tip of the at least one fork arm in the image data, for calculating at least one marking indicating a position of the fork, and for reproducing on the monitor image data captured by the fork arm camera and superimposed with the marking.

Identical or similar advantages accrue to the industrial truck as have been previously mentioned with respect to the method for operating the industrial truck, so that repetitions can be avoided.

The industrial truck is particularly refined in that the marking indicates the top sides and/or the outer edges of the fork arms and/or the center between the fork arms.

The industrial truck is refined according to a further advantageous embodiment, such that the processing unit is further set up for receiving data relating to an angle of inclination of the fork and for calculating on the basis of said data an auxiliary marking indicating a deviation of the position of the fork from a zero-degree position of the fork and for reproducing on the monitor image data captured by the fork arm camera and superimposed with the auxiliary marking.

It is further particularly provided that the industrial truck is refined in that the processing unit is further set up for receiving data relating to a steering movement angle and for calculating on the basis of said data an additional auxiliary marking indicating a future deviation of the position of the fork from the current position thereof in a plane of transport for assumed travel at the steering movement angle, and for reproducing on the monitor image data captured by the fork arm camera and superimposed with the additional auxiliary marking.

According to a further advantageous embodiment, a load to be picked up having at least two visible load support areas is present in the captured image data, wherein the processing unit is further set up for calculating target positions of the tips of the fork arms when inserted into the visible load support areas, and for displaying on the monitor image data captured by the fork arm camera and superimposed with the calculated target positions of the tips of the fork arms.

Finally industrial truck is advantageously refined in that the fork arm camera is set up for capturing live image data and the processing unit is set up for performing the steps indicated in real time and for reproducing on the monitor a superposition of a live image and the marking calculated in real time. This can optionally be modified such that the fork arm positions and the resulting positions of the particularly vertical and/or horizontal markings, particularly the main lines and/or auxiliary lines, are calculated and are valid or displayed as long as the fork arms are not displaced.

Further features of the invention are disclosed by the description of embodiments according to the invention, together with the claims and the attached drawings. Embodiments according to the invention can fulfill individual features or a combination of a plurality of features.

BRIEF DESCRIPTION OF THE DRAWINGS

The invention is described below, without limiting the general idea of the invention, using embodiment examples with reference to the drawings, wherein reference is made expressly to the drawings with respect to all details not explained further in the text. In the drawings.

In the drawings, identical or similar elements and/or parts have the same reference numerals, so that repeated depiction is disregarded.

DETAILED DESCRIPTION OF THE INVENTION

Figure 1:
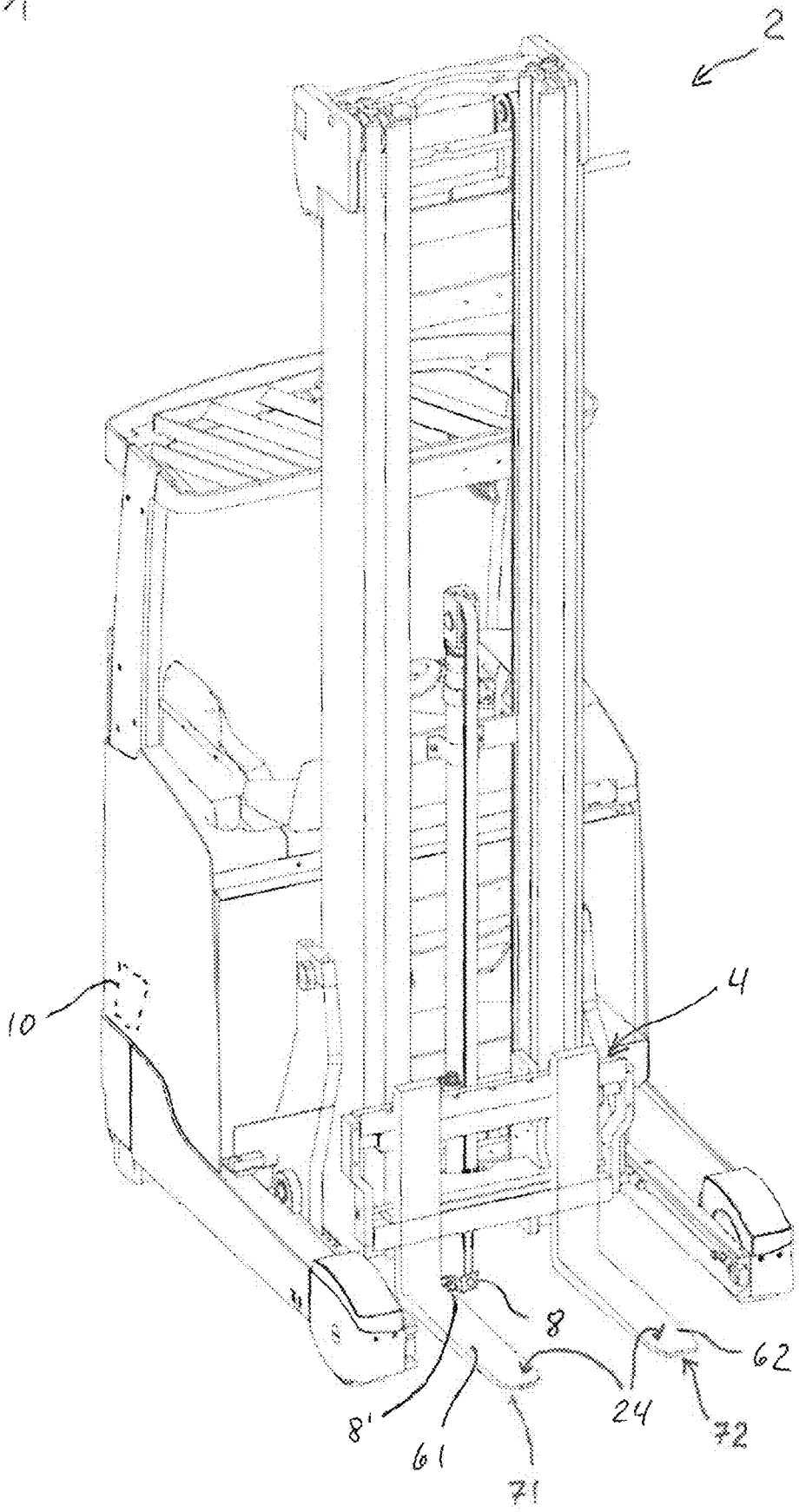
FIG. 1 An industrial truck in schematically simplified perspective view.

FIG. 1 shows a schematically simplified perspective view of an industrial truck 2 having a fork 4 comprising at least two fork arms 61, 62 and a fork arm camera 8, 8' mounted on the fork 4. In the present embodiment example, a fork arm camera 8 can either be disposed on the back of the fork or in the form of an alternative or additional placement as a fork arm camera 8' directly on the fork 4, in the present case on the inner side of a fork arm 61.

The industrial truck 2, for example a forklift, further comprises a monitor, not shown in the figure, present in the field of view of a driver of the industrial truck 2. Further comprised is a processing unit 10 indicated schematically. Said unit serves for reading and processing the image data captured by the fork arm camera 8, 8' and for producing and transmitting processed image data shown on the monitor. In deviation from the example shown in FIG. 1, the processing unit 10 can also be integrated in the fork arm camera 8, 8 or in the monitor. The fork arm camera 8, 8' is disposed on the fork 4 of the industrial truck 2 such that at least part of a tip 71, 72 of at least one of the two fork arms 61, 62 is present in the field of view of the fork arm camera 8, 8'. The industrial truck 2 comprises an assistance system comprising at least the fork arm camera 8, 8', the monitor, and the processing unit 10.

Figure 2:
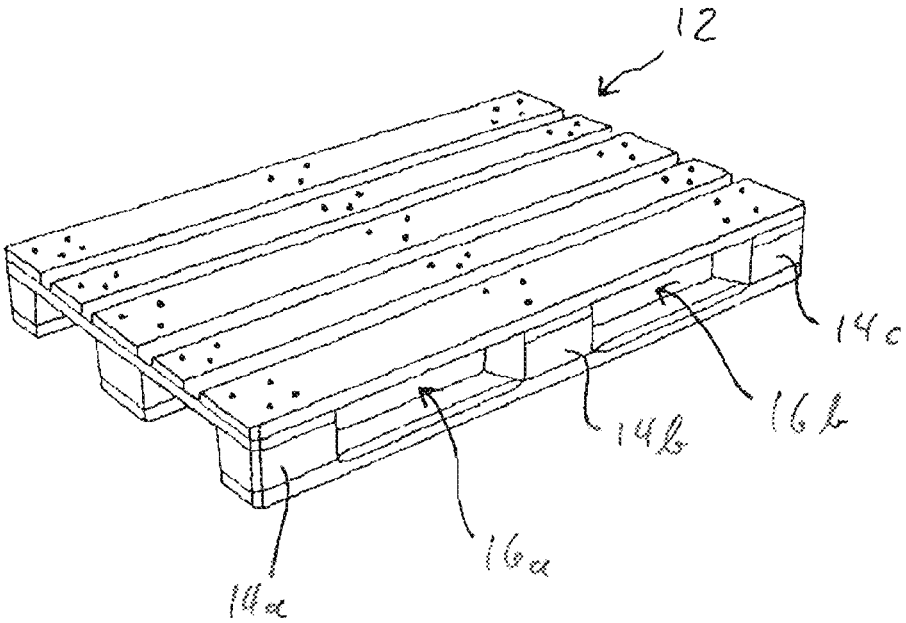
FIG. 2 A pallet for a load to be picked up in a schematically simplified perspective view, FIG. 3 An example of an image reproduced on the monitor, in which the image captured by the fork arm camera is displayed superimposed with a marking, wherein the main marking and the auxiliary marking deviate from each other, FIG. 4 An example of an image reproduced on the monitor, in which the image captured by the fork arm camera is displayed superimposed with a marking, wherein the main marking and the auxiliary marking are congruent, and FIG. 5 Image data captured by the fork arm camera superimposed with calculated target positions of the tips of the fork arms, wherein the image shows a schematically depicted rack.

FIG. 2 shows a schematically simplified perspective view of a pallet 12 as used for receiving goods and stored in a high-bay warehouse, for example. The industrial truck 2 picks up such a pallet 12 in the load support areas 16*a*, 16*b* present between adjacent pallet blocks 14*a*, 14*b*, 14*c*. For this purpose, the fork arms 61, 62 are inserted into the corresponding load support areas 16*a*, 16*b*. Especially in poor lighting or at a great working height, said procedure requires great skill in handling the industrial truck 2. The fork arm camera 8, 8' provides the driver of the industrial truck 2 with an image on the monitor facilitating insertion into the pallet.

Figure 3:
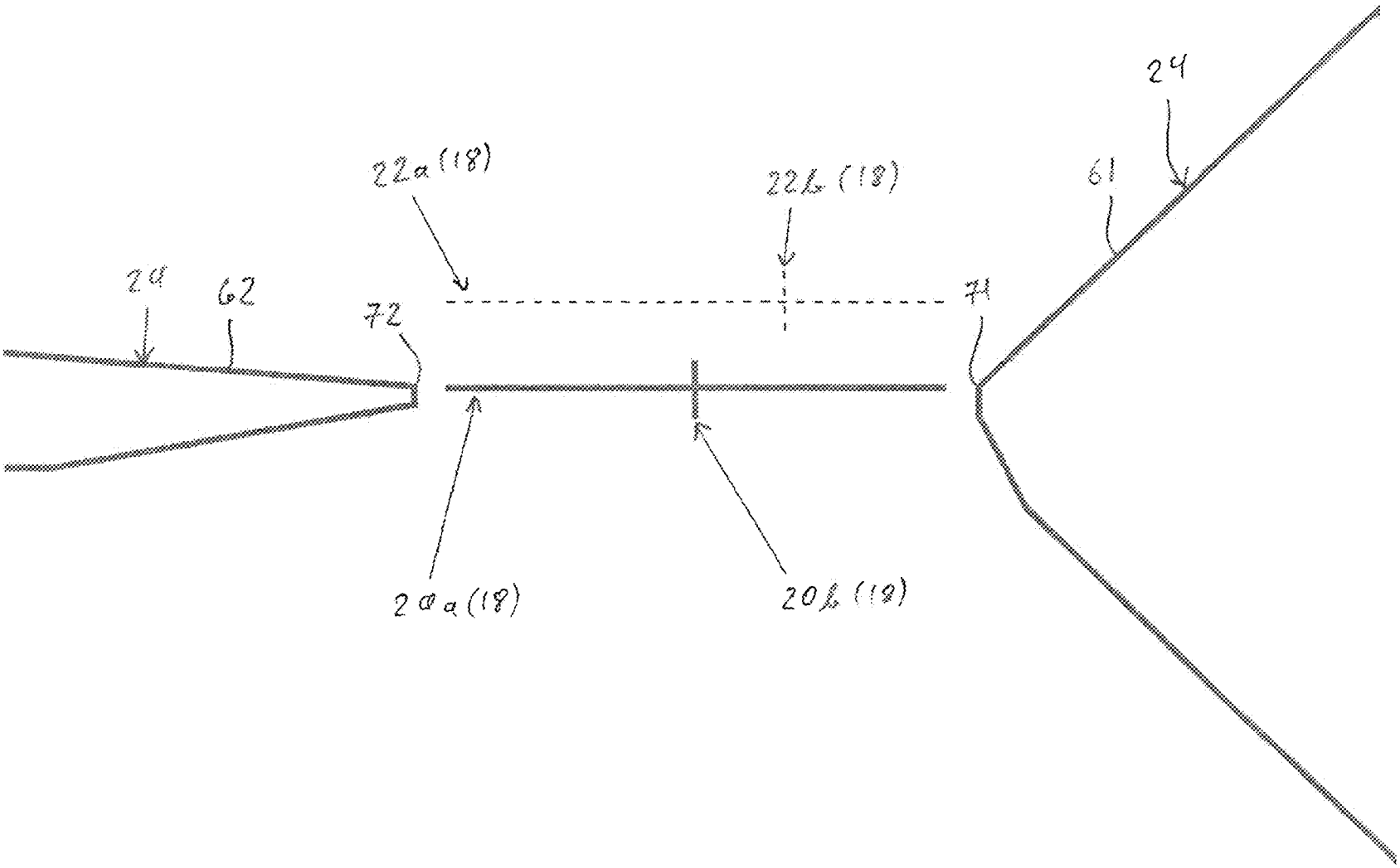

FIG. 3 shows an example of an image reproduced on the monitor of the industrial truck 2 in a schematically simplified view. The image captured by the fork arm camera 8, 8' is superimposed with various markings in the view on the monitor.

The inner sides of the fork arms 61, 62 are visible in a direction facing toward the tips 71, 72 of the fork arms 61, 62. A first and a second main marking 20*a*, 20*b* and a first and a second auxiliary marking 22*a*, 22*b* are present as markings 18. The first main marking 20*a*, for example a horizontal line shown in color, indicates a location of a top side 24 (cf. FIG. 1) of the fork arms 61, 62. The location of said main marking 20*a* indicating a position of the fork 4 is calculated by the processing unit 10 from the image data captured by the fork arm camera 8, 8'.

It is further provided as an example that the outer edges of the fork arms 61, 62 are displayed as the marking 18. Details are provided, however, in conjunction with FIG. 5. A second main marking 20*b* is visible in FIG. 3, indicating a center between the two fork arms 61, 62. Said marking is a colored, illuminated vertical line, for example. When approaching the pallet 12 shown as an example in FIG. 2, the driver of the industrial truck 2 can aim the second main marking at the center pallet block 14*b*, so that the driver can insert the tips 71, 72 of the fork arms 61, 62 safely and reliably into the load support areas 16*a*, 16*b* present on both sides of said center pallet block 14*b*.

The processing unit 10 further receives data relating to an angle of inclination of the forks 4 and calculates the auxiliary marking 22*a* on the basis of said data, FIG. 3 shows a situation in which the fork 4 of the industrial truck 2 is tilted downward from the horizontal, for example. This means that the tips 71, 72 of the fork arms 61, 62 are tilted downward out of a horizontal plane. For such a position of the forks 4, the top side 24 of the fork arms 61, 62 would collide with the pallet 12 when inserted into said pallet. The first auxiliary marking 22*a* shows the position of the top side 24 of the fork arms 61, 62 if the angle of inclination were zero degree, unlike the actual present angle, that is, if the top side 24 of the fork arms 61, 62 were aligned at least approximately horizontally. Using the deviation between the first auxiliary marking 22*a* and the first main marking 20*a*, the driver of the industrial truck 2 is further able to detect how severely the fork 4 is tilted.

The processing unit 10 is further set up for receiving data relating to a steering movement angle of the industrial truck 2. The second auxiliary marking 22*b* is calculated on the basis of said data. Said marking indicates a future deviation of the center between the fork arms 61, 62 when traveling in the plane of transport at the set steering movement angle. In other words, the second auxiliary marking 22*b* indicates where the second main marking 20*b* will be in a short time when traveling at the set steering movement angle. Said information indicates to the driver of the industrial truck 2 that a steering movement angle deviating from straight travel has currently been set. The marking 22*b* further enables the driver to aim the second auxiliary marking 22*b* at the center pallet block 14*b*, so that successful insertion into the load support area 16*a*, 16*b* of the pallet 12 occurs after the travel of the industrial truck 2 is completed.

Figure 4:
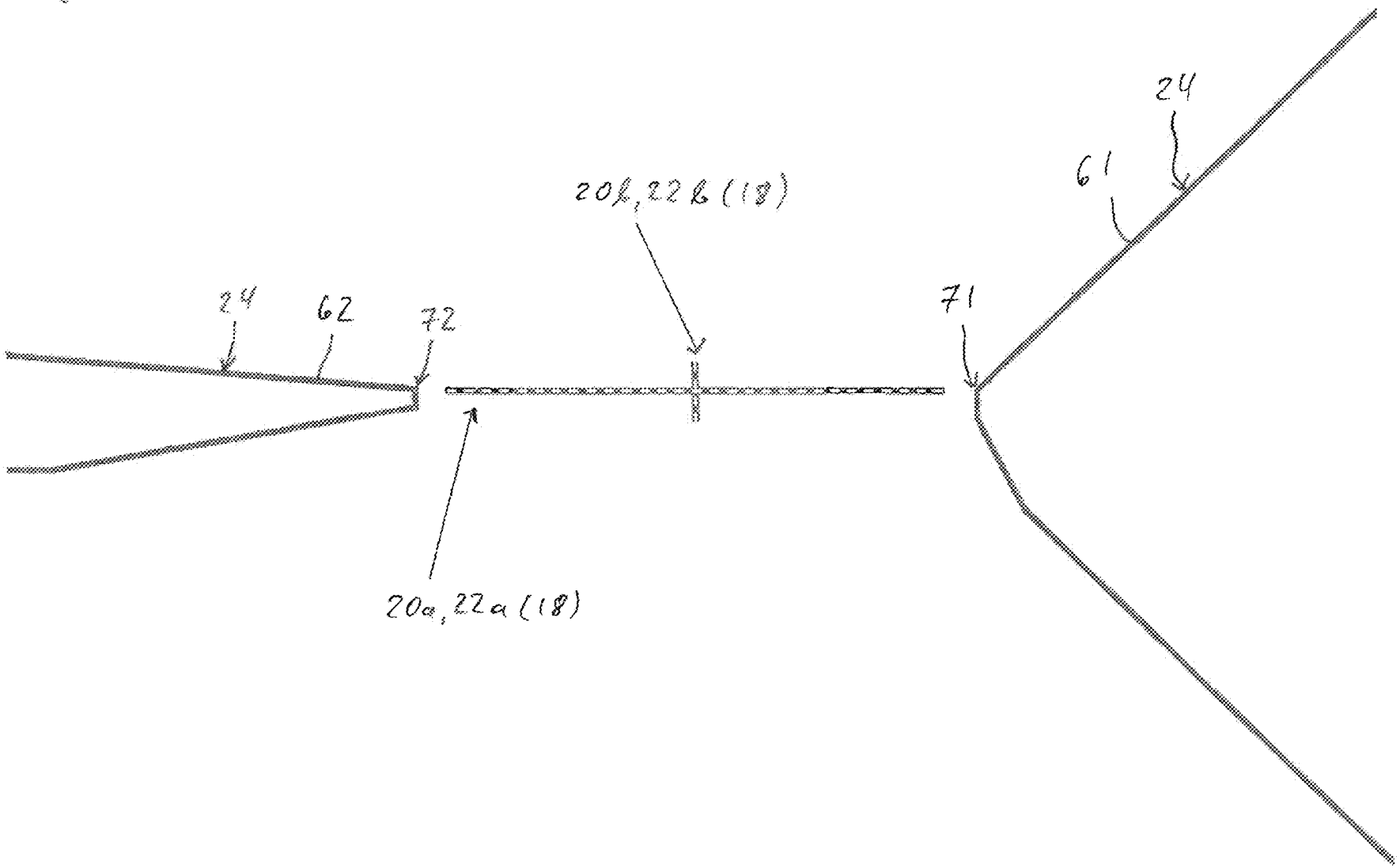

FIG. 4 shows the image of the fork arm camera 8, 8' reproduced on the monitor, wherein the main markings 20*a*, 20*b* and the auxiliary markings 22*a*, 22*b* are congruent. This means, in other words, that the fork 4 of the industrial truck 2 is aligned horizontally and the steering movement angle for straight travel is equal to zero. The main markings 20*a*, 20*b* and the auxiliary markings 22*a*, 22*b* can be distinguished in the display on the monitor by color or structurally. For example, the main markings 20*a*, 20*b* are shown by means of a solid line, and the auxiliary markings 22*a*, 22*b* are shown as a dashed line. Different colors, line weights, brightnesses, or the like can be provided for the corresponding markings 20*a*, 20*b* or 22*a*, 22*b*.

According to a further embodiment, image data of a load to be picked up, such as a pallet 12, is present in the captured image data of the fork arm camera 8, 8', wherein the processing unit 10 identifies load support areas 16*a*, 16*b* of said load to be picked up.

Figure 5:
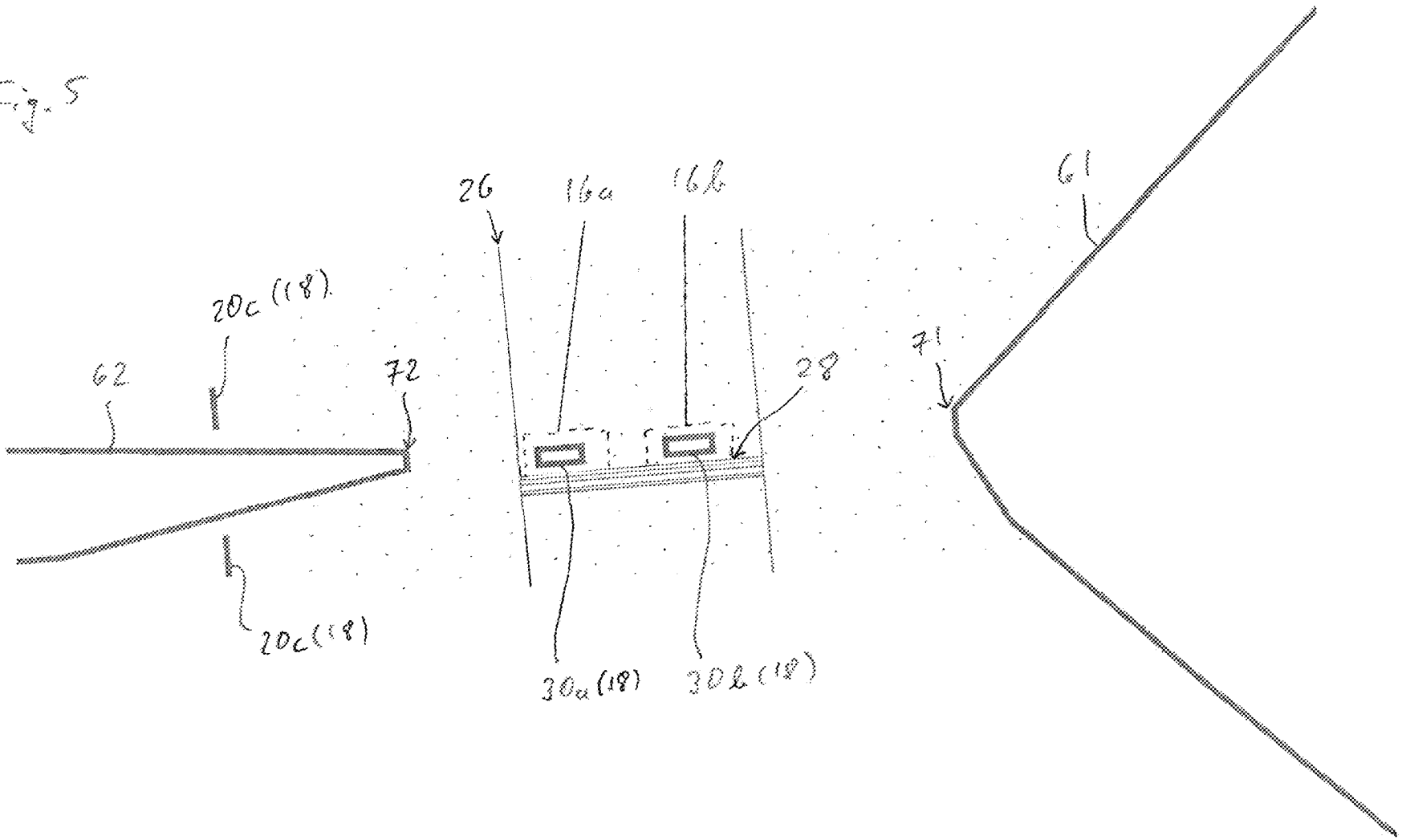

FIG. 5 shows an image of the fork arm camera 8, 8' reproduced on the monitor, wherein the industrial truck 2 is traveling toward a schematically indicated rack 26 having an example of a bay comprising a rack floor 28, for example. The outer edges of the second fork arm 62 are shown as an example of the third main marking 20*c*. Starting from the load support areas 16*a*, 16*b* (indicated by a dashed line) detected in the rack 26, target positions 30*a*, 30*b* of the tips 71, 72 of the fork arms 61, 62 are calculated when the fork arms 61, 62 are inserted into the load support areas 16*a*, 16*b*. Said target positions 30*a*, 30*b*, shown as colored squares, for example, are superimposed on the image data of the fork arm camera 8, 8' and displayed on the monitor. As the distance from the fork 4 decreases, for example when traveling toward the rack 26, said target positions 30*a*, 30*b* are dynamically adjusted. The driver of the industrial truck 2 can successively make or hold congruent the tips 71, 72 of the fork arms 61, 62 and said target position 30*a*, 30*b*, so that safe and reliable pallet insertion is ensured for example.

It is particularly provided that the fork arm camera 8, 8' captures live image data and the processing unit 10 is set up for performing real-time data processing. A live image is thus shown on the monitor with markings 18 calculated in real time.

The industrial truck 2 shown is a forklift, for example, and the load to be picked up is a pallet 12, for example. The system described above, however, can also be used correspondingly without limitation on other industrial trucks or other loads to be picked up.

All features indicated, including those found alone in the drawings, and all features, including individual features, disclose in combination with other features, are considered to be essential to the invention both alone and in combination. Embodiments according to the invention can be fulfilled by individual features or a combination of a plurality of features. Features labeled as "particularly" or "preferably" within the invention are understood to be optional.

REFERENCE LIST

2 Industrial truck
4 Fork
8, 8' Fork arm camera
10 Processing unit
12 Pallet
14*a*-14*c* Pallet blocks
16*a*, 16*b* Load support areas
18 Marking
20*a* First main marking
20*b* Second main marking
20*c* Third main marking
22*a* First auxiliary marking
22*b* Second auxiliary marking
24 Top side
26 Rack
28 Rack floor
30*a*, 30*b* Target positions
61, 62 Fork arms
71, 72 Tips

What is claimed:

1. A method for operating an industrial truck having a fork, at least two fork arms, a fork arm camera disposed on the fork such that at least part of a tip of at least one of the two fork arms is present in a field of view of the fork arm camera, a monitor, and a processing unit for processing image data captured by the fork arm camera and for producing and transmitting processed image data for display on the monitor, the method comprising:

identifying a position of the at least part of the tip of the at least one of the two fork arms within the image data captured by the fork arm camera, calculating at least one marking indicating a position of the fork based on the position of the at least part of the tip of the at least one of the two fork arms identified within the image data captured by the fork arm camera, and reproducing on the monitor the image data captured by the fork arm camera superimposed with the calculated at least one marking.

2. The method according to claim 1, wherein the marking indicates one or more of:

a top side of the least one of the two fork arms;

an outer edge of the at least one of the two fork arms; and a center between the two fork arms.

3. The method according to claim 1, wherein the processing unit is configured to receive data relating to an angle of inclination of the fork and to calculate based on said data an auxiliary marking indicating a deviation of the position of the fork from a zero-degree position of the fork, and wherein the auxiliary marking is also superimposed on the image data captured by the fork arm camera and reproduced on the monitor.

4. The method according to claim 3, wherein the processing unit is configured to receive data relating to a steering movement angle and to calculate based on said data a further auxiliary marking indicating a future deviation of the position of the fork from a current position thereof in a plane of transport for assumed travel at the steering movement angle, and wherein the further auxiliary marking is also superimposed on the image data captured by the fork arm camera and reproduced on the monitor.

5. The method according to claim 1, further comprising capturing a load to be taken up having at least two visible load support areas in the captured image data, calculating target positions of tips of the two fork arms to be inserted into the at least two visible load support areas, and reproducing the image data captured by the fork arm camera superimposed with the calculated target position of the tips of the two fork arms on the monitor.

6. The method according to claim 1, wherein live image data is captured by the fork arm camera and the processing unit calculates at least one marking indicating the position of the fork in real time, and wherein the live image data and the superimposed calculated at least one marking indicating the position of the fork in real time is reproduced on the monitor.

7. An industrial truck comprising an assistance system and a fork comprising at least two fork arms, wherein the assistance system comprises at least one fork arm camera, a monitor, and a processing unit for processing image data captured by the at least one fork arm camera, wherein the at least one fork arm camera is disposed on the fork such that at least part of a tip of at least one of the two fork arms is present in a field of view of the fork arm camera, and wherein the processing unit is configured to:

identify a position of the at least part of the tip of the at least one fork arm within the image data captured by the fork arm camera, calculate at least one marking indicating a position of the fork based on the position of the at least part of the tip of the at least one fork arm within the image data captured by the fork arm camera, and reproduce on the monitor the image data captured by the fork arm camera superimposed with the calculated marking.

8. The industrial truck according to claim 7, wherein the calculated marking indicates one or more of:

a top side of the at least one of the two fork arms;

an outer edge of the at least one of the two fork arms; and a center between the two fork arms.

9. The industrial truck according to claim 7, wherein the processing unit is configured to:

receive data relating to an angle of inclination of the fork;

calculate based on said data an auxiliary marking indicating a deviation of the position of the fork from a zero position of the fork; and display on the monitor image data captured by the fork arm camera superimposed with the calculated auxiliary marking.

10. The industrial truck according to claim 9, wherein the processing unit is configured to receive data relating to a steering movement angle and calculate based on said data an additional auxiliary marking indicating a future deviation of the position of the fork from a current position thereof in a plane of transport for assumed travel at the steering movement angle, and to reproduce on the monitor image data captured by the fork arm camera superimposed with the calculated additional auxiliary marking.

11. The industrial truck according claim 7, wherein a load to be taken up having at least two visible load support areas is present in the captured image data, wherein the processing unit is configured to calculate target positions of tips of the two fork arms to be inserted into the at least two visible load support areas, and to reproduce the image data captured by the fork arm camera superimposed with the calculated target position of the tips of the two fork arms on the monitor.

12. The industrial truck according to claim 7, wherein the fork arm camera is configured to capture the image data as live image data, and wherein the processing unit is configured to identify the at least part of the tip of the at least one fork arm in the live image data captured by the fork arm camera, and reproduce on the monitor the live image data captured by the fork arm camera superimposed with the calculated marking in real time.

* * * * *